United States Patent [19]

Huibers et al.

[11] 4,404,084

[45] Sep. 13, 1983

[54] COAL HYDROGENATION AND DEASHING IN EBULLATED BED CATALYTIC REACTOR

[75] Inventors: Derk T. A. Huibers, Pennington; Edwin S. Johanson, Princeton, both of N.J.

[73] Assignee: Hri, Inc., Lawrenceville, N.J.

[21] Appl. No.: 357,230

[22] Filed: Mar. 11, 1982

[51] Int. Cl.[3] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 2,987,465 | 6/1961 | Johanson | 208/10 |
| 3,477,941 | 11/1969 | Nelson | 208/10 |
| 3,954,595 | 5/1976 | Sze et al. | 208/10 |
| 3,962,070 | 6/1976 | Stotler | 208/10 |
| 4,040,957 | 8/1977 | Sze et al. | 208/10 |
| 4,221,653 | 9/1980 | Chervenak et al. | 208/10 |

*Primary Examiner*—Delbert E. Gantz

*Assistant Examiner*—Lance Johnson

*Attorney, Agent, or Firm*—V. A. Mallare; F. A. Wilson

[57] ABSTRACT

An improved process for hydrogenation of coal containing ash with agglomeration and removal of ash from an ebullated bed catalytic reactor to produce deashed hydrocarbon liquid and gas products. In the process, a flowable coal-oil slurry is reacted with hydrogen in an ebullated catalyst bed reaction zone at elevated temperature and pressure conditions. The upward velocity and viscosity of the reactor liquid are controlled so that a substantial portion of the ash released from the coal is agglomerated to form larger particles in the upper portion of the reactor above the catalyst bed, from which the agglomerated ash is separately withdrawn along with adhering reaction zone liquid. The resulting hydrogenated hydrocarbon effluent material product is phase separated to remove vapor fractions, after which any ash remaining in the liquid fraction can be removed to produce substantially ash-free coal-derived liquid products.

15 Claims, 2 Drawing Figures

COAL
$H_2$
ASH

CALCULATION BASIS:
FLUID DENSITY = 0.8 gm/cc
CAT. DENSITY = 1.5 gm/cc
(SOAKED)
PARTICLES DENSITY = 2.0 gm/cc
PACKED BED VOIDS = 35 %

COAL HYDROGENATION AND DEASHING IN EBULLATED BED CATALYTIC REACTOR

BACKGROUND OF THE INVENTION

This invention pertains to coal catalytic hydrogenation to produce hydrocarbon liquid and gas products, and particularly to a coal hydrogenation process in which ash from the coal is agglomerated in and withdrawn from an ebullated bed catalytic reactor.

In conventional catalytic coal liquefaction and hydrogenation processes which use high pressure hydrogen to produce hydrocarbon liquid and gaseous products, the separation of fine particles of ash from the coal-derived liquid product is a major problem. Such ash separation is usually accomplished by passing the coal-derived liquid through a liquid-solids separation step such as hydroclones, filters, or to a solvent precipitation step. However, such ash separation processes are expensive and troublesome to use, and improved procedures for more direct removal of ash from coal-derived liquids have been sought. Although it is known to withdraw small portions of used catalyst particles from ebullated catalyst bed reactors used in coal hydrogenation processes, as generally disclosed by U.S. Pat. No. 3,398,085 to Engle and U.S. Pat. No. 3,519,555 to Keith, et al., agglomeration and selective withdrawal of a significant portion of the ash particles from the catalytic reaction zone has not previously been considered feasible.

SUMMARY OF INVENTION

The present invention provides a coal catalytic hydrogenation process to produce hydrocarbon liquid and gas products, and utilizes an ebullated bed catalytic reaction zone for both coal hydrogenation and deashing of the liquid product. In the process, the feed coal in particulate form and containing ash is mixed with sufficient hydrocarbon slurrying liquid to provide a flowable coal-oil slurry, and the slurry is fed together with hydrogen into a reaction zone containing an ebullated bed of particulate high activity catalyst. The slurry liquid and hydrogen are passed upwardly through the catalyst bed at flow rate sufficient to expand the bed, which is maintained at elevated temperature and pressure conditions sufficient to hydrogenate the coal and release fine particulate ash from the coal. The reaction zone slurry liquid is also maintained at upward velocity and viscosity selected to permit agglomeration of the ash from the coal into larger size particles in the reaction zone and to accumulate the aggomerated ash in a layer located above the ebullated catalyst bed. The resulting hydrogenated hydrocarbon liquid and gas products and the agglomerated ash particles are withdrawn separately from the reaction zone. The hydrogenated hydrocarbon effluent material product is withdrawn from the upper portion of the reaction zone above the agglomerated ash layer, and is phase separated to provide gaseous and deashed liquid product fractions. The agglomerated ash is withdrawn from the ash layer along with a minimal amount of adhering and accompanying reaction zone liquid to provide a flowable slurry, and the ash-liquid slurry is further processed to at least partially recover the hydrocarbon liquid portion.

DESCRIPTION OF INVENTION

Figure 1:
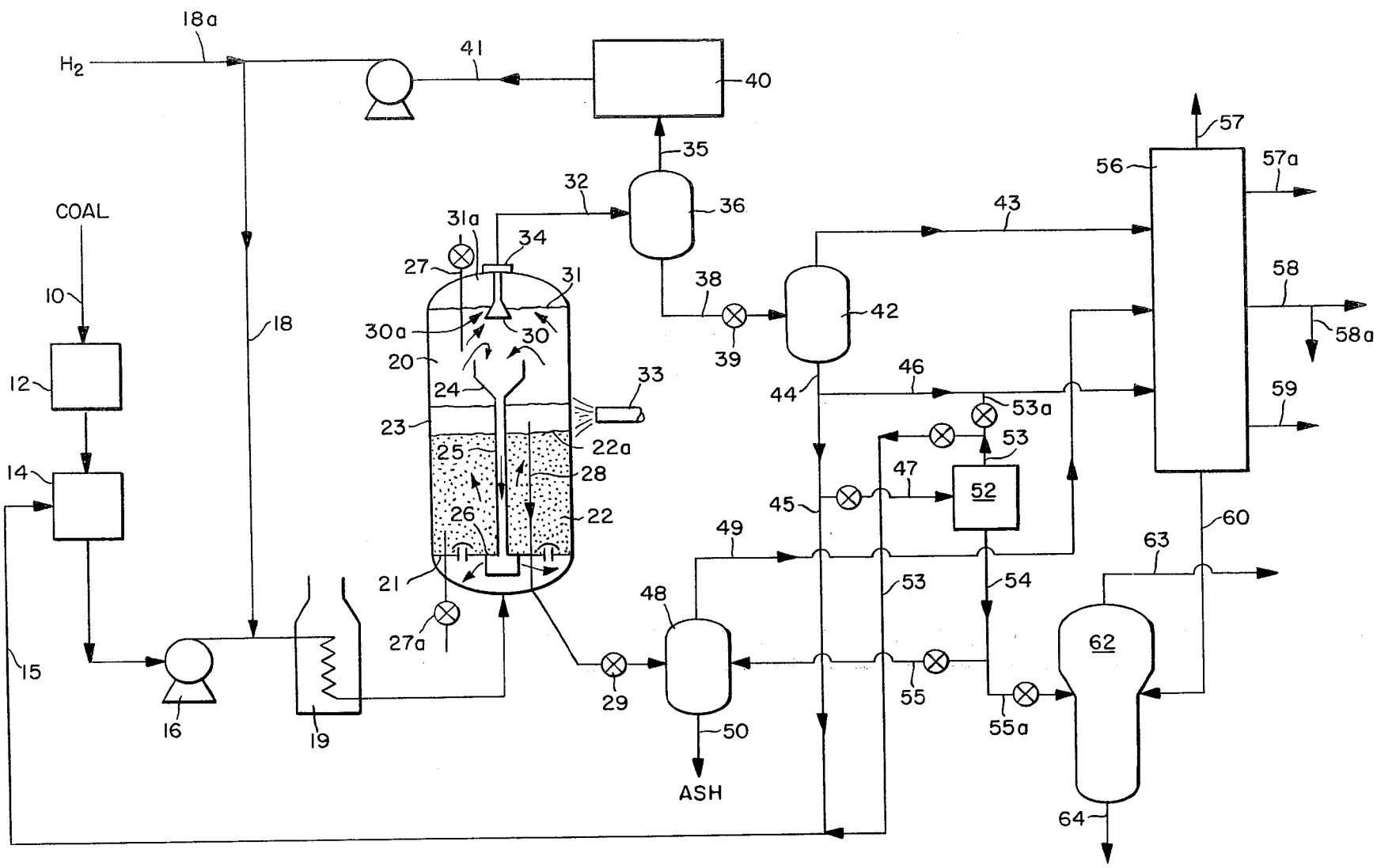
FIG. 1 is a schematic flow diagram of a catalytic coal hydrogenation process in which ash is agglomerated and withdrawn from the reactor in accordance with the invention.

In the present invention, catalytic hydrogenation of a flowable coal-oil slurry feed along with hydrogen to produce hydrocarbon liquid and gas products and also provide substantial deashing of the coal is achieved by operating the ebullated bed reaction zone so as to maintain upward liquid flow velocity such that ash particles released from the coal are carried upward through the ebullated catalyst bed, and are agglomerated to form larger particles, but are not carried out of the reactor along with the effluent liquid product. Thus, the agglomerated ash particles are accumulated in an ash layer located above the expanded catalyst bed, and are withdrawn from that layer, usually downwardly through a conduit extending into the ash layer and removed from the reaction zone along with a minimal amount of adhering and accompanying reactor liquid.

The upward liquid velocity required to produce such agglomeration and accumulation of ash will depend mainly on catalyst particle size used, the viscosity of the reactor liquid slurry, and the agglomerated ash particle size. The liquid superficial upward flow velocity needed is usually about 0.02–0.30 ft/sec, and preferably is 0.03–0.20 ft/sec, and is provided mainly by an internal liquid recycle flow rate which can be 10–40 gallons per minute/ft$^2$, reactor cross-sectional area. It is also usually necessary to carry out the process at reaction conditions that produce a low viscosity liquid slurry in the reaction zone, such as having a broad viscosity range of about 0.1 to 2.0 centipoise at reactor conditions, and preferably 0.2–1.5 centipoise. Reaction conditions should be maintained within a broad range of 750°–900° F. temperature and 1000–5000 psi hydrogen partial pressure, and preferably 780°–880° F. temperature and 1500–4000 psig hydrogen partial pressure. Coal feed rate or space velocity should be between about 10–60 lb/hr.ft$^3$ reactor volume. In order to achieve good process operability and deashing at these reaction conditions, it is also preferable to use a high activity hydrogenation catalyst having a particle diameter of 0.020–0.065 inch.

It has been unexpectedly found that by using these catalytic reaction zone conditions, fine ash particles released from the coal feed will agglomerate to form larger particles in a layer in the upper portion of the reaction zone above the catalyst bed. The agglomerated ash particles form a separate ebullating layer supported above the catalyst bed. When the agglomerated ash particles increase to at least a certain critical size, such as at least about 90 W % larger than about 200 mesh (74 microns), intermittent or continuous withdrawal of the agglomerated ash along with a minimal amount of adhering and accompanying reactor liquid can begin, usually downwardly through a withdrawal conduit. Ash removal directly from the reactor will be beneficial in prolonging useful life of the catalyst, since it is expected that the fine ash will tend to deposit preferentially on the agglomerated ash particles rather than on the catalyst.

To increase the effectiveness of ash removal from the reactor, it is desirable to agglomerate the ash particles to as large a size as possible, which will not usually exceed about 50 mesh (300 microns). The particle size of the ash agglomerated and separated in the reaction zone is controlled by maintaining the process conditions, as described above, by the rate of agglomerated ash withdrawal from the reactor, and also by the addition of a light hydrocarbon liquid fraction into the reaction zone upper portion. More specifically, this ash agglomeration and removal process can be facilitated by the addition of a hydrocarbon liquid fraction having a normal boiling point below about 400° F. and containing aromatic compounds such as cresols and other monoaromatic compounds whose critical points are slightly below the reaction temperature. Such liquid addition is preferably made into the reactor above the expanded catalyst bed, and can be a relatively small percentage such as 2–10 W % of the coal feed. This liquid addition will also assist in reducing the reactor liquid viscosity as well as agglomeration of ash particles, and thereby increase the range of operability of the combined coal hydrogenation and deashing process.

The accumulation of an agglomerated ash-rich material above the expanded catalyst bed can also be facilitated by use of a baffle means positioned in the upper portion of the reactor upstream of the effluent liquid product withdrawal conduit, to retard the withdrawal of ash particles along with the hydrogenated liquid overhead effluent product. The mixture of agglomerated ash and minimal accompanying reactor liquid withdrawn from an ash layer above the catalyst bed in the reactor can be further processed to recover some of the liquid portion such as in a phase separation step followed by a solids separation step.

It is a major benefit from this combined catalytic coal hydrogenation and deashing process that a significant portion of the ash released from the coal can be withdrawn from the reaction zone as a concentrated slurry of ash and coal-derived oil. Thus, subsequent processing of the entire reactor liquid effluent material for removal of ash can be minimized or even avoided, which represents a major cost saving.

The invention will now be further described by reference to FIG. 1, in which a coal at 10, such as bituminous or subbituminous coal having ash content of 5–15 W %, is usually ground, dried, and screened at 12, and is sized to substantially all pass 30 mesh screen (0.023 inch) and preferably is 40–325 mesh screen size (0.0165–0.0017 inch) U.S. Sieve Series. The particulate coal is then slurried at 14 with a sufficient hydrocarbon slurrying oil 15 to provide a flowable coal-oil slurry feed material having an oil/coal weight ratio ranging from about 1.2:1.0 to about 4.0:1.0. The resulting coal-oil slurry is pressurized at 16 to an elevated pressure and is combined with a hydrogen-rich gas at 18. The coal-oil-gas mixture is then heated at heater 19 and introduced into the bottom of the upflow hydrogenation reactor 20 through flow distributor 21. Reactor 20 contains ebullated catalyst bed 22, with the catalyst usually being extrudates having diameter of 0.020 to 0.065 inch (500–1600 microns).

The reactor 20 is adapted for providing a liquid-phase reaction of the particulate coal, hydrogen gas and particulate hydrogenation catalyst placed in random ebullated motion therein by the upflowing liquid and gas. Reaction conditions are preferably maintained within the ranges of 780°–880° F. temperature and 1500–4000 psi, hydrogen partial pressure. The coal feed rate should preferably be about 20–50 lb/hr/ft$^3$ reactor volume. The reactor liquid is recycled preferably internally downward through vapor-liquid separator or recycle cup 24 and downcomer conduit 25 to recycle pump 26, so as to maintain the desired extent of catalyst bed expansion in the reactor, such as about 10 to 50 percent over the bed settled height. Such reactor liquid recycle rate usually ranges between about 20–30 gallons per minute per ft$^2$ reactor cross-sectional area, and liquid upflow superficial velocity is maintained at 0.03–0.20 ft/sec and the reactor liquid viscosity is 0.2–1.5 centipoise. Fresh catalyst is added at 27 and used catalyst is withdrawn at **27*a* as needed to maintain the desired catalytic activity in the reactor. Fine particles of ash are released from the feed coal and are agglomerated to form larger particles in ash layer 23 in the upper portion of the reactor above catalyst bed 22 but below recycle cup 24. The agglomerated ash layer 23 is indicated by level and concentration detector 33, and the ash is withdrawn either intermittently or continuously from above the catalyst bed 22 along with a minimal amount of adhering and accompanying reactor liquid downwardly through conduit 28 and control valve 29**.

As also shown in FIG. 1, a deflection means such as baffle 30 can be provided in the vapor disengagement zone **31*a* located above liquid recycle cup 24 to facilitate ash agglomeration in layer 23. The baffle 30 is solid and oriented in such position so as to deflect the upflowing agglomerated ash solids downwardly and thus partially shield the opening 32*a* to effluent withdrawal conduit 32. Baffle 30 thereby provides for a partial separation of agglomerated ash solids from smaller sized particulate solids in the reactor, and thus selectively reduces the percentage of larger ash solids entering the withdrawal conduit 32 along with combined hydrocarbon liquid and vapor material. One suitable deflector or baffle configuration for this invention includes a flat plate oriented at an angle with the horizontal of about 0 to 45 degrees, and usually having a horizontally projected area equal to about 2 to 20 times the cross-sectional area of the withdrawal conduit. Baffle 30 is preferably supported from conduit 32 by at least three structural rods 30*a*. The conduit 32 and connected baffle 30 are preferably made removable from the upper end of reactor 24 through removable bolted flange 34**.

A catalytically reacted effluent material product containing combined hydrocarbon liquid and gas fractions is withdrawn from the upper part of the reactor 20 through conduit 32 above catalyst bed upper level **22*a* and liquid level 31 and is passed to phase separator 36. The resulting vapor portion 35 is passed to hydrogen purification step 40, from which the recovered hydrogen gas is repressured and recycled at 41 for use as the recycled hydrogen-rich gas at 18, along with any needed high purity make-up hydrogen gas at 18*a*. The remaining liquid stream 38 is pressure-reduced at 39 and passed to second phase separator 42, wherein the vapor portion 43 is again separated from the liquid portion and passed to fractionation system 56. The resulting liquid stream 44 is usually divided and a portion 45 is recycled as slurrying oil 15, while the remaining portion 46 is passed to fractionation section 56**.

The agglomerated ash material along with a minimal amount of adhering and accompanying reactor liquid is withdrawn from ash layer 23 in reactor 20 via conduit 28 and is pressure-reduced at valve 29 and passed to phase separator 48, wherein the absorbed vapor portion is flashed at lower pressure such as 25–50 psig and removed as stream 49 and also passed to fractionator 56. The remaining liquid-solids slurry material 50 is withdrawn and can be passed to further processing steps as desired for recovery of the hydrocarbon liquid portion.

If it is desired to remove any remaining ash material from the resulting liquid stream at 44 a portion 47 can be passed to a liquid-solids separation step 52, which can comprise multiple hydroclones, filters, or a solvent precipitation system. Overflow stream 53 containing a reduced concentration of particulate solids is then used as slurrying oil 15, and a portion 53*a* can also be passed along with stream 46 to fractionation system 56. In this system, the material is usually separated into a gas stream at 57, a light distillate liquid fraction normally boiling between about 400° and 600° F. removed at 58, heavy distillate product at 59, and a bottom fraction removed at 60, having a normal boiling range in excess of 800° F. and usually about 800° to 975° F. If desired, a portion 58*a*, of the relatively solids-free oil at 58 can be recycled as a portion of coal slurrying oil 15 to coal-oil slurry step at 14. Also, if desired, stream 60 can be passed to vacuum distillation step 62 to recover additional light oil fraction as stream 63. The underflow liquid stream at 54, containing an increased concentration of fine unconverted coal and some ash solids, can be passed as stream 55 to separator 48 or as stream 55*a* to vacuum distillation at 62. Vacuum bottoms material 64 having normal boiling temperature of 975° F.+ is withdrawn as a heavy product material. Also, if desired, a light liquid fraction boiling at about 300°–400° F. is withdrawn from fractionation system 56 at 57*a* and added into the upper portion of reactor 20 above the catalyst bed 22 to assist in the desired agglomeration of ash in layer 23.

It is an advantage of this invention that the ash agglomeration provided in the reactor upper end provides sufficient ash solids removal directly from the reactor that an external conventional solids separation step, such as by hydroclones, centrifuge, filtration, or solvent precipitation, is minimized or may even be eliminated depending upon the acceptable solids concentration level in the product liquid streams. Thus, elimination of such an external solids separation step reduces the process cost and complexity.

This invention will be further described by reference to the following example of operations, which should not be construed as limiting in scope.

EXAMPLE 1

Illinois No. 6 bituminous coal having 50–300 mesh particle size (U.S. Sieve Series) and containing 11.3 W % ash was fed as a coal/oil slurry with hydrogen into a reactor 0.814-inch inside diameter by 12 foot long containing an ebullated catalyst bed, maintained at elevated temperatures and pressure conditions to produce hydrocarbon liquid and gas products. After about 130 hours operation the reactor pressure differential increased excessively and the reactor was shutdown. Inspections performed following shutdown indicated that a plug of about 76 W % agglomerated ash solids material had developed in the upper end of the reactor, indicating that an excessive amount of ash had unexpectedly agglomerated and was retained in the upper portion of the reactor, instead of being carried out with the effluent liquid product stream. The particle size of the accumulated ash material ranged from 70 to 325 mesh (U.S. Sieve Series) (200–400 microns). The operating conditions used and results for the catalytic reaction step are provided in Table 1 below.

TABLE 1

CONDITIONS FOR ASH AGGLOMERATION IN CATALYTIC REACTION ZONE

| | Standard Operation | Ash Separation Operation |
|---|---|---|
| Reaction Conditions: | | |
| Temperature, °F. | 850 | 850 |
| $H_2$ Partial Pressure, psig | 1800 | 1800 |
| Coal Feed Rate, lb/hr/ft$^3$ | 50 | 50 |
| Internal Liquid Recycle, gal/min/ft$^2$ | 28 | 20.4 |
| Slurry Oil Recycle, lb/lb coal | 1.5 | 3.0 |
| Catalyst Used | HDS-1442A | Amocat 1A |
| Catalyst Extrudates Size, inch | 0.065 × 0.250 | 0.055 × 0.112 |
| Percent Bed Expansion | 50 | 20–30 |
| Reactor Liquid Upward Superficial Velocity, ft/sec | 0.10 | 0.06 |
| Reactor Liquid Viscosity, Centipoise | 1.0 | 0.66 |
| Duration of Run, hrs. | >200 | 140 |
| Ash Accumulation Above Catalyst Bed | No | Yes |
| Partical Size Distribution of Agglomerated Ash: | | |
| <325 mesh (45μ) | | 10 W % |
| 200–325 mesh (74–45μ) | | 10 |
| 140–200 mesh (105–74μ) | | 20 |
| 100–140 mesh (150–105μ) | | 40 |
| 70–100 mesh (200–150μ) | | 20 |

Based on a material analysis of the plug formed in the reactor upper end, it was determined that the reactor plug formed because of ash agglomeration in the reactor liquid in combination with liquid upflow velocity that was insufficient to carry the ash particles out of the reactor. These ash agglomeration conditions were facilitated by the high activity of the catalyst, which unexpectedly reduced the viscosity of the residual oil portion of the reactor liquid and caused reduced internal recycle rate for the reactor liquid and reduced catalyst bed expansion. However, by controlling the reaction zone upward liquid velocity and liquid viscosity within the appropriate selected ranges, in accordance with this invention, ash released from the coal can be agglomerated and accumulated in the upper portion of the reactor above the catalyst bed and withdrawn therefrom.

Figure 2:
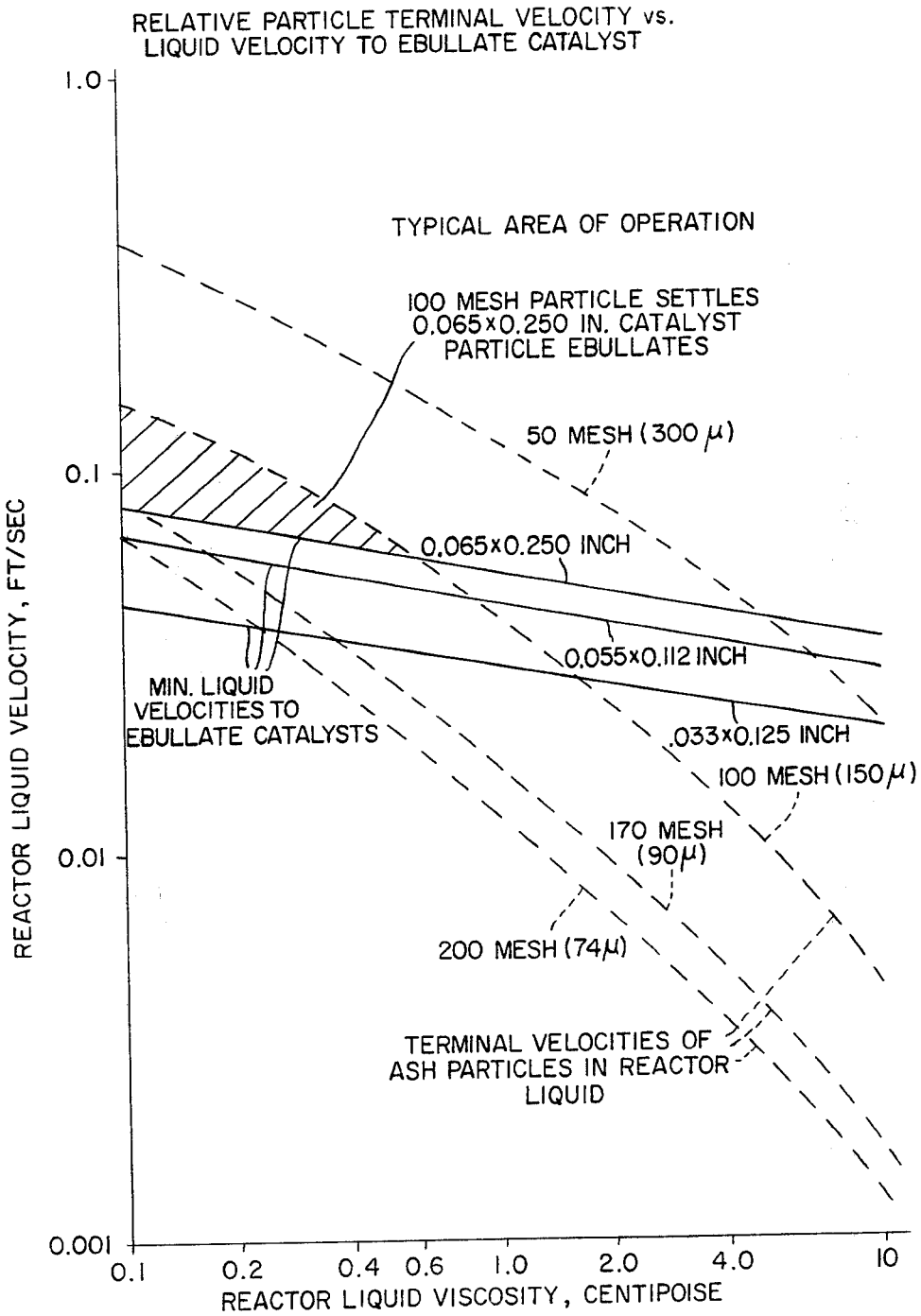
FIG. 2 is a graph showing the general relationship between reactor liquid upward velocity and reactor liquid viscosity needed to permit agglomeration and accumulation of ash in the reactor above the ebullated catalyst bed.

The general relationships which exist between the reactor liquid upflowing superficial velocity and reactor liquid viscosity for various useful catalyst average particle size and agglomerated ash particle size is shown in FIG. 2, and is based partly on other data subsequently obtained for the catalytic hydrogenation of coal. It is noted that ash agglomeration and accumulation in the reactor occurs in the region to the left of the intersecting curves, and is facilitated by using catalyst particle size smaller than about 0.065 inch diameter by 0.250 inch long and by having agglomerated ash particles larger than about 200 mesh (74 microns).

EXAMPLE 2

Bituminous coal having particle size of 50–300 mesh (U.S. Sieve Series) and containing 5–15 W % mineral matter is slurried with sufficient hydrocarbon liquid to provide a flowable coal-oil slurry and is fed with hydrogen into a reactor containing a bed of particulate high activity hydrogenation catalyst having particle size not exceeding about 0.065 inch diameter×0.250 inch long.

The reactor is maintained at reaction conditions of 800°–875° F. temperature, and 1800–3000 psig hydrogen partial pressure. The coal-oil liquid slurry material in the reactor is recycled at upward velocity sufficient to expand the catalyst bed by 20–50 percent above its settled height, and to provide liquid upward superficial velocity of 0.03–0.15 ft/sec. Under these conditions the reactor liquid viscosity is about 0.30–1.2 centipoise, so that fine particulate ash is released from the coal during the hydrogenation reaction and the ash is agglomerated in the reactor upper portion to produce larger particles of ash having at least about 50 W % larger than about 140 mesh (100 microns). This agglomerated ash is accumulated at a level in the reactor above the expanded catalyst bed but below the inlet of a conduit leading downwardly to a reactor liquid recycle pump.

An effluent stream containing hydrocarbon liquid and vapor and less than about 50 W % of the ash in the coal feed is withdrawn overhead from the reactor. The agglomerated ash material along with a minimal amount of adhering and accompanying reactor slurry liquid is withdrawn downwardly and out of the reactor. This ash-enriched liquid stream is pressure-reduced to about 50 psig pressure and the adsorbed vapors are removed by being flashed at the lower pressure and passed to a fractionation step. The remaining ash-liquid stream is further processed to recover a substantial portion of the lower boiling liquid fraction, after which the material is withdrawn for gasification or disposal.

Although this invention has been described broadly and with reference to certain embodiments thereof, it will be understood that modifications and variations to the process can be made within the spirit and scope of the invention, which is defined by the following claims.

We claim:

1. A process for coal hydrogenation and deashing to produce hydrocarbon liquid and gas products, comprising:

(a) mixing particulate coal containing ash with a hydrocarbon slurrying liquid to provide a flowable coal-oil slurry, and feeding the slurry with hydrogen into a reaction zone containing a bed of particulate hydrogenation catalyst;

(b) passing said coal-oil slurry and hydrogen upwardly through said catalyst bed at flow rate sufficient to expand the bed and provide an ebullated bed of said particulate catalyst, maintaining said reaction zone at 750°–900° F. temperature and 1500–5000 psig, hydrogen partial pressure, and at liquid upward superficial velocity and viscosity selected to permit agglomeration of fine ash particles released from the coal, whereby the coal is catalytically hydrogenated and the fine particulate ash is agglomerated to form increased particle sizes and the agglomerated ash is accumulated in an ash layer in the upper portion of the reaction zone above the catalyst bed;

(c) withdrawing said agglomerated ash along with a minimal amount of accompanying reaction zone liquid from said ash layer in said upper portion of said reaction zone;

(d) withdrawing a hydrogenated hydrocarbon effluent material product from the upper portion of said reaction zone above said agglomerated ash layer, and phase separating the effluent material into gaseous and liquid fractions, and (e) withdrawing deashed hydrocarbon liquid and gaseous products from the process.

2. The process of claim 1, wherein the ash removed from the coal is agglomerated to have particle size of at least about 90 W % larger than about 200 mesh (74 microns).

3. The process of claim 1, wherein the reaction zone liquid upward superficial velocity is maintained at 0.02–0.30 ft/sec.

4. The process of claim 1, wherein the reaction zone liquid viscosity is maintained at 0.1–2.0 centipoise.

5. The process of claim 1, wherein said ebullated catalyst bed is expanded to about 10–50 percent above the bed settled height by recycle of the reaction zone slurry liquid upwardly through the catalyst bed.

6. The process of claim 1, wherein said hydrocarbon slurrying liquid is a coal-derived liquid having normal boiling range of about 400°–800° F.

7. The process of claim 1, wherein said reaction zone effluent liquid fraction is passed to a liquid-solids separation step for removing any remaining ash particles from said liquid.

8. The process of claim 1, wherein a light coal-derived fraction normally boiling below about 400° F. and containing monoaromatic fractions is added to the upper portion of the reaction zone to promote agglomeration of the ash in the reaction zone.

9. The process of claim 1, wherein the flow of hydrocarbon effluent material withdrawn from the reaction zone is deflected by baffle means located to selectively reduce the withdrawal of agglomerated ash particles overhead from the reaction zone.

10. The process of claim 1, wherein said reaction zone is maintained at 780°–880° F. temperature, and 1500–4000 psig hydrogen partial pressure.

11. The process of claim 1, wherein the coal feed contains 5.0 to 15 W % ash.

12. The process of claim 9, wherein the coal is Illinois No. 6 coal.

13. The process of claim 1, wherein said catalyst bed contains a particulate high activity hydrogenation catalyst material having average particle size not exceeding about 0.065 inch diameter by 0.250 inch long.

14. The process of claim 1, wherein said agglomerated ash is withdrawn from said reaction zone along with minimal accompanying reaction zone liquid, and the combined liquid-ash slurry is pressure-reduced and phase separated to produce a vapor fraction and a liquid fraction containing said agglomerated ash material.

15. A process for hydrogenation and deashing of coal to produce hydrocarbon liquid and gas products, comprising:

(a) mixing particulate coal containing ash with a hydrocarbon slurrying liquid to provide a flowable coal-oil slurry, and feeding the slurry with hydrogen into a reaction zone containing a bed of particulate high activity hydrogenation catalyst;

(b) passing said slurry liquid and hydrogen upwardly through said catalyst bed along with recycled liquid at flow rate sufficient to expand the bed and provide an ebullated bed of said particulate catalyst, maintaining said reaction zone within a temperature range of 750°–900° F., a hydrogen partial pressure range of 1500–5000 psig, and catalyst bed expansion of 10–40% above its settled height, and at upward superficial liquid velocity of 0.02–0.30 ft/sec., and reactor liquid viscosity of 0.1–2.0 centipoise, whereby the coal is catalytically hydrogenated and fine particulate ash is released from the coal and is agglomerated to form increased particle sizes and the agglomerated ash is accumulated in a layer in the upper portion of the reaction zone above the catalyst bed;

(c) withdrawing said agglomerated ash along with a minimal amount of adhering and accompanying reaction zone liquid from said ash layer in said upper portion of said reaction zone;

(d) withdrawing a hydrogenated hydrocarbon effluent material product from the upper portion of said reaction zone above said agglomerated ash layer and phase separating the effluent material into gaseous and liquid fractions, and (e) withdrawing substantially deashed hydrocarbon liquid and gaseous products from the process.

* * * * *